United States Patent [19]

Joyce

[11] 4,074,920

[45] Feb. 21, 1978

[54] MINING APPARATUS AND METHOD FOR AN AUGERED SEAM

[76] Inventor: James V. Joyce, Box E, Andover, N.Y. 14806

[21] Appl. No.: 713,245

[22] Filed: Aug. 10, 1976

[51] Int. Cl.[2] ..... E21C 27/30; E21C 41/00

[52] U.S. Cl. ..... 299/18; 37/135; 214/1 MS; 299/67

[58] Field of Search ..... 299/18, 19, 64, 67; 214/1 MS; 37/135

[56] References Cited

U.S. PATENT DOCUMENTS

| | | | |
|---|---|---|---|
| 729,566 | 6/1903 | Foglesong | 299/18 |
| 1,023,370 | 4/1912 | Frink | 37/135 |
| 3,135,061 | 6/1964 | Perry et al. | 37/135 X |
| 3,597,865 | 8/1971 | Rumfelt | 37/135 |
| 3,776,594 | 12/1973 | Haspert | 299/18 |

FOREIGN PATENT DOCUMENTS

| | | | |
|---|---|---|---|
| 877,808 | 9/1961 | United Kingdom | 37/135 |

*Primary Examiner*—Ernest R. Purser
*Attorney, Agent, or Firm*—Anthony J. DeLaurentis

[57] ABSTRACT

A technique for mining coal or similar mineral employing existing auger holes or a specially drilled bore hole into the face of the coal, a guide anchor rod being inserted into the hole and having a pulley at its inner end, a first cable passing over the pulley pulls a coal recovery scoop into the hole, an additional cable is attached to the scoop and extends out of the hole to a winch which pulls the scoop and the coal out of the hole, and thereafter the first cable retracts the scoop into the hole to start another cycle of operation.

15 Claims, 7 Drawing Figures

FIG. 1
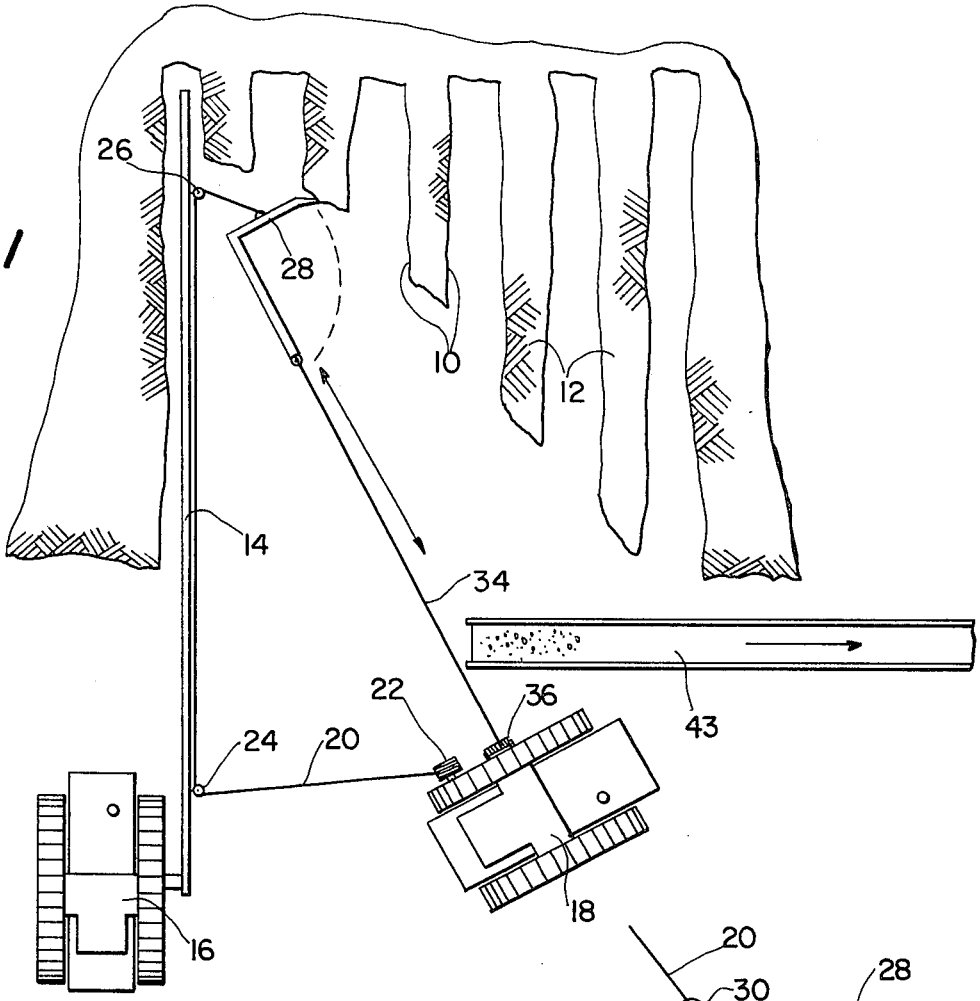
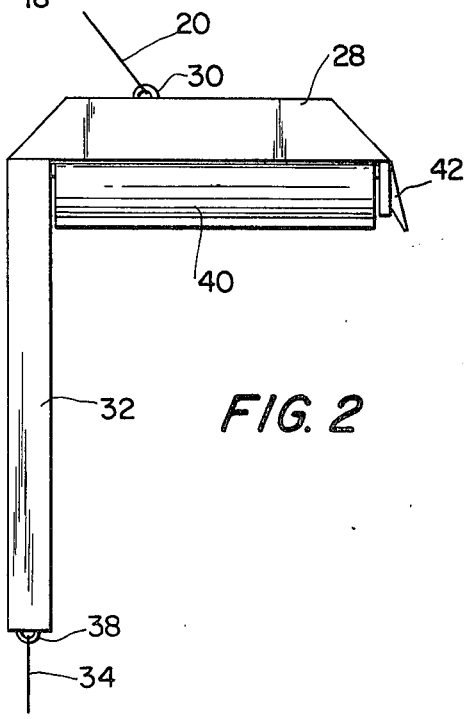
FIG. 2
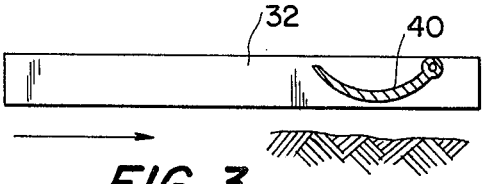
FIG. 3
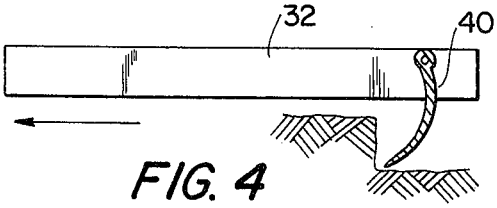
FIG. 4

MINING APPARATUS AND METHOD FOR AN AUGERED SEAM

BACKGROUND OF THE INVENTION

The present invention relates to mining techniques and in particular to an improved apparatus and method of mining which utilizes existing auger holes or alternatively a specially drilled hole into the face of the mineral into which holes apparatus for recovering the mineral especially coal is inserted.

Augering is a conventional surface mining technique which frequently follows behind a strip mining operation. In any event, a horizontal bench is cut upon which the auger is disposed, and the auger holes are drilled into the coal seam at the bottom of the vertical high wall of the cut. When augering follows strip mining, augering recovers additional coal when it is no longer feasible to take a larger cut by strip mining, for example, due to the height of the high wall and the amount of overburden which would have to be removed to expose additional coal. The auger is then employed to drill holes in the order of 100–200 feet depending upon conditions. When one auger hole is completed, the auger is retracted and the apparatus is moved over and another hole started a few inches from the previous hole. In view of the coal left between auger holes and because these holes are circular, the amount of coal recovered by augering is usually in the order of 50%.

SUMMARY OF THE INVENTION

A primary object of the present invention is to provide an improved technique for mining coal and like minerals. Another object of the invention is to obtain increased recovery of coal by mining coal normally left between auger holes.

According to the present invention, a guide anchor bar is inserted into an auger hole after a series of auger holes have been drilled or alternatively into a bore hole drilled especially to receive the guide anchor bar. A cable, which is trained about a pulley or the like at the end of the anchor bar in the bore hole, is designed to pull a recovery scoop into the bore hole. According to one embodiment of the invention, the recovery scoop is drawn outwardly via another cable attached to the scoop at one end and to a recovery winch on a tractor or the like at the other end. The scoop is drawn against the side of the auger hole to dislodge and recover this coal. If desired, initially a ripper member may be employed to dislodge the coal and to break through the coal between adjacent auger holes. Thereafter the ripper may be withdrawn and replaced by a scoop device which is designed to have greater capacity for recovering loosened coal.

After the coal has been removed, the high wall may collapse filling in the mined out area and releaving stresses in the overlying rock formation.

The above and other objects, features and advantages of the invention will become more apparent as this description proceeds.

BRIEF DESCRIPTION OF THE DRAWINGS

FIG. 1 is a somewhat diagrammatic top view taken partly in horizontal section of a presently preferred embodiment of the invention.

FIG. 2 is a perspective view of a coal recovery scoop in accordance with the invention.

FIG. 3 is a vertical cross-sectional view through the recovery scoop of FIG. 2 showing a coal recovery blade in inactive position while the scoop is being pulled into the hole.

FIG. 4 is a view similar to FIG. 3 showing the scoop with its blade in its extended position for scooping up coal as the scoop is pulled out of the hole.

Figure 5:
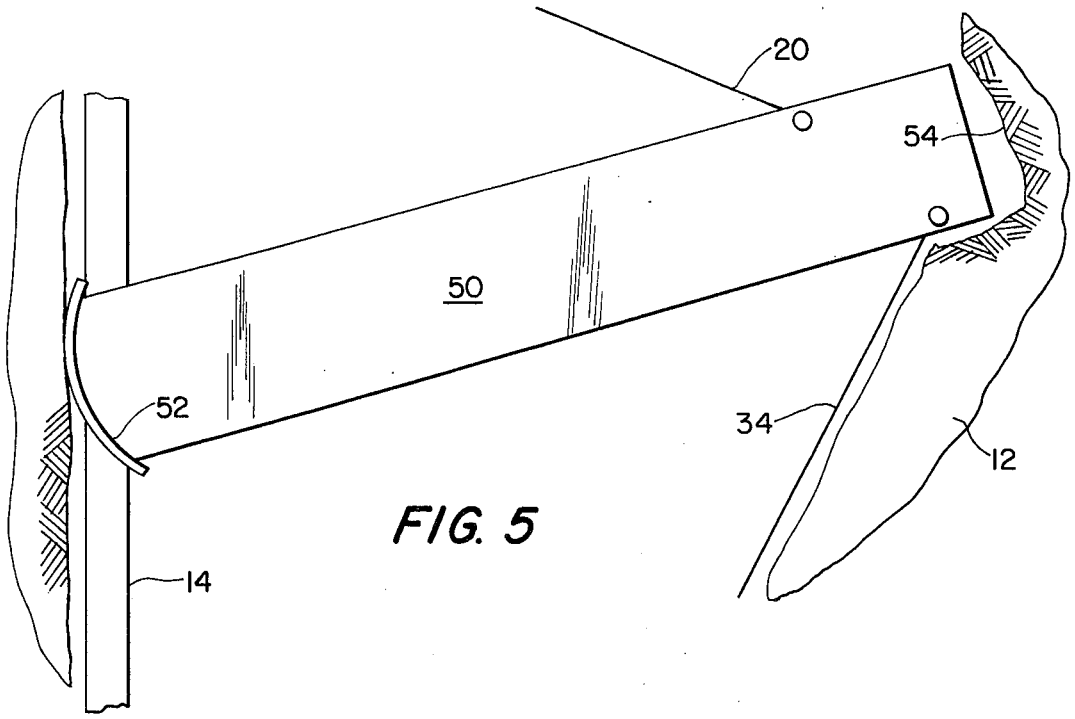
FIG. 5 is a part plan, part vertical cross-sectional view showing a ripper member in operation.

Referring now to the drawings, and more particularly to FIG. 1, the invention is illustrated as being employed in the recovery of coal left after drilling a series of auger holes 10 in a coal seam leaving pillars 12 of coal between adjacent holes. For clarity, the thickness of pillars 12 relative to the size of the auger holes 10 has been exaggerated. In addition, the size of auger holes 10 and pillars 12 relative to hereinafter described equipment has been exaggerated.

At anchor bar 14 which is mounted on a first tractor 16 is inserted into the first of the series of auger holes 10. Anchor bar 14 extends substantially to the inner or closed end of the auger hole. A second tractor 18 referred to as the recovery tractor is located adjacent the stationary first tractor 16. A first cable 20 extends from a winch 22 on tractor 18 about a pulley 24 on anchor bar 14 adjacent the tractor 16 and then inwardly parallel to the anchor bar where it is passed about a pulley 26 adjacent the other end of the anchor bar. The cable 20 which passes around pulley 26 is attached to a recovery scoop 28 via an eyelet 30. The cable 20 functions to retract the recovery scoop to the rear of the auger hole.

The recovery scoop has an outwardly extending arm 32 generally at right angles to the remainder of the scoop. A recovery cable 34 extends from a second winch 36 on the recovery tractor 18 to an eyelet 38 on the leading edge of the arm 32 of the recovery scoop. The scoop has a pivotal arcuate blade 40 extending perpendicular to arm 32. At the end of blade 40 opposite arm 32 there is a ripper tooth 42 for engaging the coal seam. When the cable 20 pulls the recovery scoop into the auger hole, the blade 40 is pivoted upwardly to an inoperative position to ride over the loose coal more easily, as seen in FIG. 3. When the scoop has been fully retracted into the hole, some tension is maintained on cable 20. Now winch 36 is actuated so that the recovery cable 34 pulls the scoop 28 into the opposite direction, i.e. towards the open end of the auger hole. With the scoop moving outwardly, the blade 40 swings downwardly by gravity and upon engaging the coal pivots to a position such as shown in FIG. 4 where it extends below the bottom of arm 32 and carries before it additional coal thereby increasing the capacity of the scoop. Depending upon the direction of pull on cable 34, there may be more or less contact of the scoop with the coal pillars 12. During such time, the tooth 42 on the scoop cuts into the pillars and provides additional loose coal to be gathered up by the scoop. Continued pull on the recovery cable 34 will eventually bring the scoop to the face of the high wall where the coal may be deposited onto a conveyor 43 such as that shown in FIG. 1 or the coal may be taken up by other means such as a front end loader.

Tractors 16, 18 may be replaced by equivalent devices such as power winch assemblies.

The position of the recovery tractor 18 and consequently the direction of pull of recovery cable 34 on the scoop may be varied. Such variation results in changing the region swept by the scoop. For example, the ripper tooth 42 and the scoop may be caused to swing through an arc shown by the dash lines from the FIG. 1 position if the tractor 18 moves to the left as seen in FIG. 1. FIG. 1 is an illustration showing the orientation of the apparatus after operating for some time and after pillars 12 between the bore holes at the left of FIG. 1 have been substantially removed. Moving the tractor 18 to the right will permit recovery of the remaining partial pillars 12. Thereafter, the anchor bar 14 may be moved over to the right and the sequence repeated. By the present invention, it is thus possible to recover coal which was heretofore left behind at the conclusion of an augering operation.

The scoop may be turned over to mine the left rather than to the right by providing additional holes (not shown) into which the shaft of blade 40 is inserted when the scoop is inverted.

While the invention has been described with reference to recovering additional coal after the completion of a conventional augering opeation, it will be appreciated that the invention is not so limited and may be practiced by drilling a single bore hole into which the anchor bar 14 and the other structure is inserted and then operating to recover coal substantially as described above with the coal bed being progressively removed and eventually the anchor bar being moved over to continue operations.

FIG. 5 illustrates another embodiment of the invention which consists of a ripper in the form of a steel plate 50. The return cable 20 is attached to plate 50 to the right of its center line, and the recovery cable 34 is attached to the plate adjacent its right end beyond the point of attachment to cable 20. Plate 50 may be, for example, a 1 inch thick steel plate in the order of 14 inches wide and 7 feet long, the dimensions will of course vary with the size of the auger hole. At the other end of the plate 50 there is a curved foot 52 of slightly larger width than that of the plate 50 and the foot extends generally at right angles to the plane of plate 50.

When cable 20 pulls the ripper plate 50 into the auger hole, the plate pivots to a position in which the width of the plate is perpendicular to the diameter of the bore hole to facilitate its being drawn into the holes. Thereafter when the recovery cable 34 is actuated, the plate 50 pivots in a clockwise direction about its point of attachment to cable 20 to a position such as that shown in FIG. 5 where the foot 52 functions as a fulcrum point in contact with the wall of the auger hole adjacent another bar 14. At the same time, the opposite end of ripper plate 50 is drawn into contact with the adjacent coal pillar 12 and dislodges coal forming a pocket 54. Additional pull on the recovery cable 34 will cause the plate 50 to rip through more of the coal expanding the pocket 54. Continued pull on cable 34 will swing the ripper plate 50 through an arc of approximately 180° from its initial position before the cable 34 was actuated. By proper manipulation of cables 20 and 34, the ripper plate may be repeatedly swung into and out of engagement with the coal pillar 12. When sufficient coal has been dislodged, the ripper plate may be removed from the auger hole and replaced by a suitable scoop which has greater coal or other mineral carrying capacity.

Figure 6:
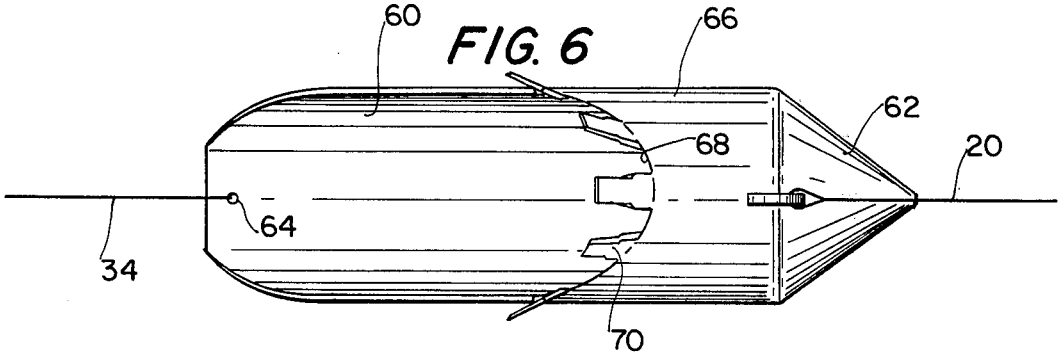
FIG. 6 is a plan view of another embodiment of a recovery scoop.

Another embodiment of a coal recovery scoop is shown in FIG. 6. In this embodiment the cable 20 for pulling the scoop into the bore hole is attached to a recovery scoop 60 at a bullet shaped end 62 of the scoop which facilitates pulling the scoop into the hole. The recovery cable 43 is secured within a hole 64 adjacent the other end of the scoop. As shown in this figure, the body of the scoop is substantially arcuate extending through an angle of about 180° and is open at the top and one end for the reception of coal. The scoop adjacent the bullet shaped end 62 is enclosed by a wall 66 to form an enclosed container for the reception of the coal. The leading edge 68 of the wall 66 is arcuate and a plurality of ripper teeth 70 extend from this edge. When the scoop is retracted by recovery cable 34, the ripper teeth 70 dislodge coal which falls into the open end of the scoop and is accumulated both beneath the wall 66 and in the open section of the scoop. When the scoop is full it is withdrawn and the coal deposited upon a conveyor or the like, and the scoop is then retracted into the hole for reuse via cable 20.

Figure 7:
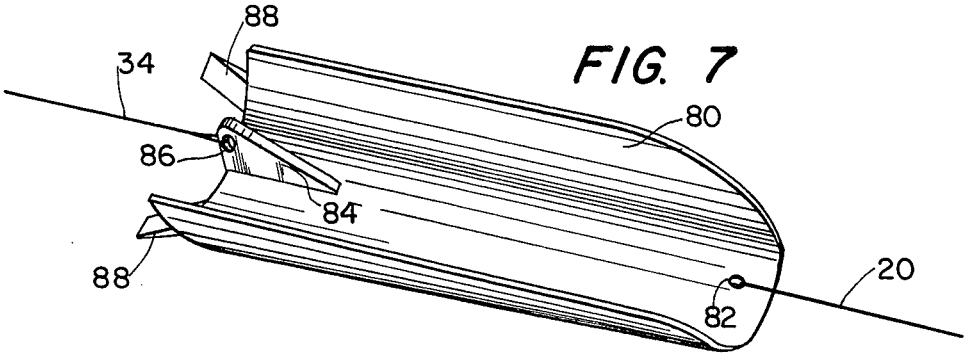
FIG. 7 is a perspective view of another embodiment of a scoop having ripper teeth at one end thereof.

Referring now to FIG. 7, another embodiment of the invention is shown comprising a recovery scoop 80 which is comprised by an elongated arcuate metal member whose walls define an arc of approximately 180°. The cable 20 for pulling the scoop into the hole is attached to one end through a hole 82 in the scoop wall. The recovery cable 34 is attached to a raised steel plate 84 which has a hole 86 for the reception of the cable. Ripper teeth 88 are disposed on both sides of plate 84. The teeth 88 assist in dislodging coal which is then taken up by the scoop. Since cable 34 is attached to the raised plate 84, it is possible to change the angle of the ripper scoop as it is pulled through the coal by changing the orientation of the cable 34. This scoop functions in the same fashion as the scoops described previously.

While presently preferred embodiments of the invention have been shown and described with particularity, it will be appreciated that the invention is not limited to the illustrative embodiments. Various changes and modifications may be made without departing from the spirit of the invention. Also, it will be appreciated that the apparatus may be utilized in the mining of other materials as well as coal. Accordingly, it is intended to cover all such changes and modifications as fall within the scope and spirit of the appended claims.

I claim:

1. Apparatus for mining coal or the like wherein an auger hole has been drilled into a seam from a face thereof and wherein the auger hole has an open end and a blind end, comprising:

elongated support means extending into the auger hole, said support means having a forward end disposed adjacent the blind end of said auger hole and a rear end disposed outside of said auger hole;

first pulley means mounted to said support means adjacent said forward end thereof;

first cable means operatively connected to said first pulley means;

coal recovery means connected to said first cable means to be pulled into said auger hole thereby, said coal recovery means being connected to said forward end of said elongated support means only by said first cable means to permit substantial freedom of movement of said recovery means relative to said support means; and second cable means connected to said coal recovery means to draw said coal recovery means out of said auger hole, the direction of movement of said second cable means being independent of the direction of elongation of said support means such that the path of travel of said coal recovery means as said means is drawn out of said auger hole is independent of the disposition of said support means.

2. Apparatus according to claim 1, wherein said elongated support means comprises an anchor bar extending approximately the length of said auger hole.

3. Apparatus according to claim 1, wherein said coal recovery means has at least one ripper tooth for dislodging coal from the wall of the seam.

4. Apparatus according to claim 1, wherein said coal recovery means comprises a scoop, said scoop having a pivotal blade moveable from inoperative retracted position to a depending position for engaging coal when said scoop is being moved by said second cable means.

5. Apparatus according to claim 4, wherein said scoop comprises a first support arm for supporting said blade, and a second arm extending generally perpendicular to said blade, and first support arm being connected to said first cable means and said second arm being connected to said second cable means, and said blade being mounted to said first support arm for freely pivotal movement relative thereto under the influence of gravity such that when said scoop is pulled into said auger hole by said first cable means said blade assumes said inoperative retracted position, and such that said blade assumes said depending position for engaging coal when said scoop is being pulled out of said auger hole by said second cable means.

6. Apparatus according to claim 1, wherein said coal recovery means comprises an elongated metal plate having first and second longitudinal sides and first and second ends, said first cable means being connected to said metal plate adjacent said first longitudinal side and said first end thereof, and said second cable means being connected adjacent said second longitudinal side of said plate and closer to said first end thereof.

7. Apparatus according to claim 6, further comprising foot means mounted to said second end of said plate, said foot means being disposed adjacent said elongated support means to function as a fulcrum upon actuation of said second cable means.

8. Apparatus according to claim 1, wherein said coal recovery means comprises an arcuate scoop, and a plurality of ripper teeth attached to said scoop.

9. Apparatus according to claim 8, further comprising wall means enclosing said scoop over a portion of its length.

10. Apparatus according to claim 8, further comprising plate means extending upwardly from the surface of said scoop, and said second cable means being connected to said plate means to vary the angle of the scoop as it is withdrawn through the coal via said second cable means.

11. Apparatus according to claim 1, further comprising winch means connected to said second cable means, said winch means being positioned upon a tractor.

12. Apparatus according to claim 11, further comprising an additional tractor connected to said elongated support means and maintaining it in position.

13. A method of mining coal or the like comprising inserting first elongated support means into an auger hole in a coal seam, said auger hole having an open end and a blind end, retracting coal recovery means into the auger hole by means of first cable means operatively connected to said first support means, and pulling said coal recovery means out of the auger hole along a path of travel independent of the disposition of said first elongated support means by means of second cable means mounted to second support means disposed outside of said auger hole to recover coal therefrom.

14. A method according to claim 13, further comprising utilizing as the auger hole one of a series of pre-existing auger holes in an exposed coal seam in a high wall.

15. A method according to claim 13, further comprising dislodging coal from the walls of the seam while withdrawing the coal recovery means from the auger hole.

* * * * *